United States Patent [19]

Shedore et al.

[11] Patent Number: 4,535,210

[45] Date of Patent: Aug. 13, 1985

[54] KEYSWITCH STABILIZING DEVICE

[75] Inventors: Charles Shedore, Elmhurst; Stanley E. Filipiak, Chicago, both of Ill.

[73] Assignee: Illinois Tool Works Inc., Chicago, Ill.

[21] Appl. No.: 601,418

[22] Filed: Apr. 18, 1984

[51] Int. Cl.[3] ..... H01H 3/12

[52] U.S. Cl. ..... 200/340

[58] Field of Search ..... 400/496; 248/27.1, 231.8, 248/316.9, 584, 585; 24/457, 458; 200/159 R, 340, 5 A

[56] References Cited

U.S. PATENT DOCUMENTS

| | | | |
|---|---|---|---|
| 3,940,578 | 2/1976 | Pointon | 200/5 A |
| 3,952,369 | 4/1976 | Erickson | 16/DIG. 13 X |
| 4,384,796 | 5/1983 | Denley | 400/496 |
| 4,392,037 | 7/1983 | Fleming | 200/340 |
| 4,433,225 | 2/1984 | Cowles | 200/340 |
| 4,453,063 | 6/1984 | Wanatowicz, Jr. et al. | 200/340 |
| 4,468,145 | 8/1984 | Denley | 400/496 |
| 4,475,832 | 10/1984 | Wachs | 400/496 |

OTHER PUBLICATIONS

IBM Technical Disclosure Bulletin, vol. 21, No. 9, Feb. 1979, "Self-Biasing Space Bar Stabilizer Mechanism", Harris.

IBM Technical Disclosure Bulletin, vol. 20, No. 4, Sep. 1977, "Counterweight Space Bar Mechanism", Harris.

*Primary Examiner*—Stephen Marcus

*Assistant Examiner*—Ernest G. Cusick

*Attorney, Agent, or Firm*—Donald D. Mondul; T. W. Buckman

[57] ABSTRACT

An apparatus for stabilizing operational movement of an actuator for a keyswitch mounted to a base, which has one or more unitary, substantially rigid members, which members are movably attached to the actuator at a first end and have a gripping means at a second end for slidingly gripping a free edge of the base.

5 Claims, 4 Drawing Figures

KEYSWITCH STABILIZING DEVICE

BACKGROUND OF THE INVENTION

The present invention is directed to a device for stabilizing operational movement of an actuator for a keyswitch mounted to a base, such as a printed circuit board for a keyboard. In today's keyboards, most key switches provide an impact zone for an operator's finger, the limits of which impact zone are generally not far displaced from the axis of movement of the keyswitch actuator. If an impact zone for a particular keyswitch is struck by an operator's finger at a point coinciding with the intersection of the impact zone and the axis of actuator movement, no moment forces are imparted to the actuator and the actuator moves freely within the keyswitch housing to accomplish its switching function. However, if the impact zone is struck by the operator's finger at a point displaced from the intersection of the impact zone of the keytop and the operating axis of the actuator, a moment force is imparted to the actuator resulting in a non-axial component of force applied to the actuator causing the actuator to engage the housing of the keyswitch during its operational movement. For those keyswitches having an impact zone substantially centered about and having limits not far displaced from the movement axis of the actuator, the maximum moment force which could be applied to the actuator by striking the impact zone at its farthest reaches is insufficient to cause such binding of the actuator as would adversely affect operation of the keyswitch. However, some keys on today's keyboards are provided with relatively large impact zones which provide possible points of contact for an operator's finger substantially removed from the axis of operation of the keyswitch actuator. Such keys may be found, for example, as certain function keys on a keyboard such as "tab", "return", or the like. Striking such a large-area key at the outer reaches of the impact zone can frequently impart sufficient moment force to the actuator to cause such binding of the actuator against the keyswitch housing as would result in unreliable and often frustrating operational characteristics of the keyswitch. The present invention is designed to overcome such shortcomings by providing a stabilizing device for large-area keys which enables striking of such large-area keys even at the outer reaches of their impact zones without imparting moment forces to the actuator sufficient to cause the actuator to bind significantly against the keyswitch housing during operational movement. Some devices have been designed to overcome the same shortcomings, such as the device disclosed in U.S. Pat. No. 4,392,037. Such devices as disclosed in that patent as well as other devices known in the prior art, however, have their own shortcomings. Some, such as the device disclosed in U.S. Pat. No. 4,392,037, occupy excessive "real estate", or board space, beyond the the limits of the keytop with which they are associated and preclude close spacing of adjacent keys to those large-area keys requiring stabilization. Other devices prove difficult to assemble, especially if the keyswitch must be stabilized in two axes. The present invention is designed to require no board space beyond the limits of the keytop to be stabilized and provides superior ease of assembly over devices of the prior art.

SUMMARY OF THE INVENTION

The invention is an apparatus for stabilizing operational movement of an actuator for a keyswitch mounted to a base and includes at least one unitary substantially rigid member movably attached to a keyswitch actuator at a first end and engaging a free edge of the base in a slidingly gripping relationship at a second end. The invention is designed to stabilize a large-area keyswitch actuator in order that striking such an actuator at a point displaced from the axis of opertional movement of the actuator will not impart moment forces to the actuator sufficent to cause the actuator to bind adversely against the keyswitch housing during its operation. Further, the invention is designed to provide such stabilization in a configuration providing ease of assembly of the keyswitch actuator to the keyswitch and ease of connection between the actuator and the base upon which the keyswitch rests while not occupying significant, if any, board space beyond the limits of the actuator being stabilized.

It is therefore an object of this invention to provide an apparatus for stabilizing operational movement of an actuator for a keyswitch mounted to a base which minimizes binding of the actuator against the keyswitch housing when the actuator is operated by impacting the actuator at a point distal from the operating axis of the actuator.

A further object of the present invention is to provide an apparatus for stabilizing operational movement of an acutuaor for a keyswitch which does not occupy significant, if any, board space beyond the limits of the actuator being stabilized.

Still a further object of the present invention is to provide an apparatus for stabilizing operational movement of an actuator for a keyswitch which is easy to assemble during manufacture.

Further objects and features of the present invention will be apparent from the following specification and claims when considered in connection with the accompanying drawings illustrating the preferred embodiment of the invention.

DETAILED DESCRIPTION OF THE DRAWINGS

DETAILED DESCRIPTIN OF THE INVENTION

Figure 1:
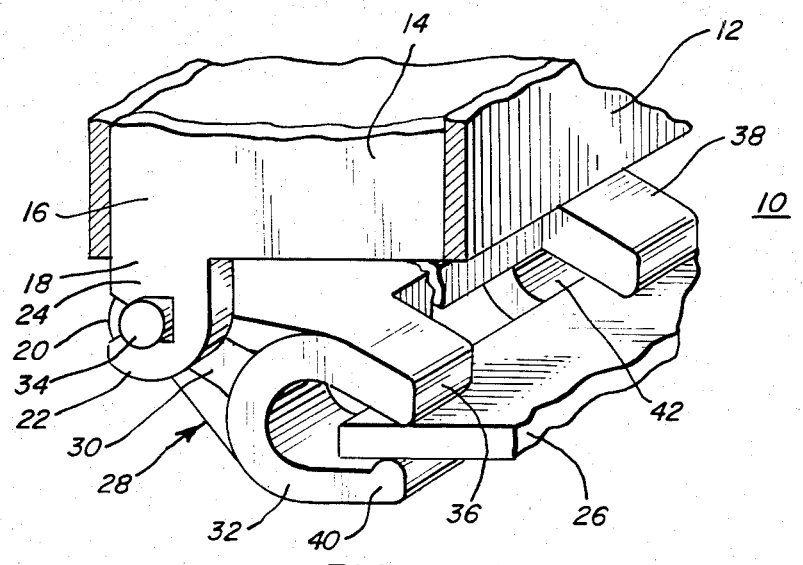
FIG. 1 is a detailed perspective view of the preferred embodiment of the present invention in partial section.

Referring to FIG. 1, a keyswitch stabilizing assembly 10 is shown in persepctive in partial section. The keyswitch stabilized in assembly 10 is comprised of a keytop 12 which is attached to the keyswitch actuator (not shown) and has inserted therein an attachment member 14. The attachment member 14 may be molded into the keytop 12 or may be otherwise inserted within the keytop 12 after molding of the keytop 12. The attachment member 14 has an attachment bar 16 and, appending therefrom, an attachment tab 18. The attachment tab 18 has a slot 20 formed by an arm 22 depending from the attachment tab 18. The attachment tab 18 has formed in its lower end an ear 24. The keyswitch (not shown) is mounted upon a base 26 and extending from the attachment member 14 to the base 26 is a stabilizing apparatus 28. The stabilizing apparatus 28 is comprised of a rigid member 30 intermediate the attachment member 14 and an engagement member 32. The rigid member 30 is attached to the attachment member 14 by pins 34 received within the slot 20. During insertion of the pins 34 within the slots 20 the arms 22 flex away from the attachment tab 18 allowing the pins 34 to pass within the slot 20 past the ear 24, and having passed within the slot 20, the arm 22 returns to its original position thereby capturing the pin 34 within the slot 20 with the ear 24 serving to retain the pin 34 within the slot 20. The engagement member 32, in the preferred embodiment of the present invention, is formed in the shape of a yoke assembly having two upper legs 36 and 38 and two lower legs 40 and 42. The stabilizing apparatus 28, therefore, extends from the keytop 12 by the attachment member 14 to the base 26 and is movably attached by the pins 34 in the slots 20 at the attachment member 14 and slidingly grippingly engages the base 26 between the upper legs 36 and 38 and the lower legs 40 and 42, thereby stabilizing the keytop 14 during depression of the keytop 14 toward the base 26 during actuation operations of the keyswitch (not shown).

In referring to alternate embodiments of the present invention, like elements will be given like reference numerals to aid in understanding of the invention.

Figure 2:
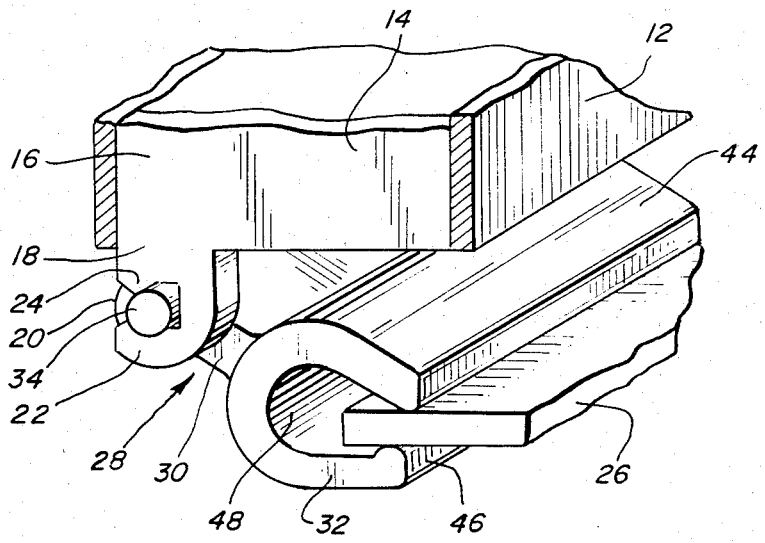
FIG. 2 is detailed perspective view of an alternate embodiment of the present invention in partial section.

FIG. 2 illustrates an alternative embodiment of the present invention having a keytop 12 with an attachment member 14, which attachment member 14 is comprised of an attachment bar 16, an attachment tab 18, a slot 20 formed by an arm 22 and the attachment tab 18, an ear 24 adjacent the slot 20, and an associated base 26. The stabilizing apparatus 28 is engaged with the attachment member 14 by pins 34 in a manner similar to the preferred embodiment of FIG. 1. Further similar to the preferred embodiment of FIG. 1, a rigid member 30 extends from the attachment member 14 toward the base 26 and has an engagement member 32 at the end of the rigid member 30 distal from the attachment member 14. In this alternate embodiment, however, the engagement member 32 is composed of a yoke having two arms 44 and 46 defining a channel 48 therebetween. The base 26 is held between the arms 44 and 46 in slidingly gripping engagement and the base 26 extends into the channel 48 defined by the arms 44 and 46.

Figure 3:
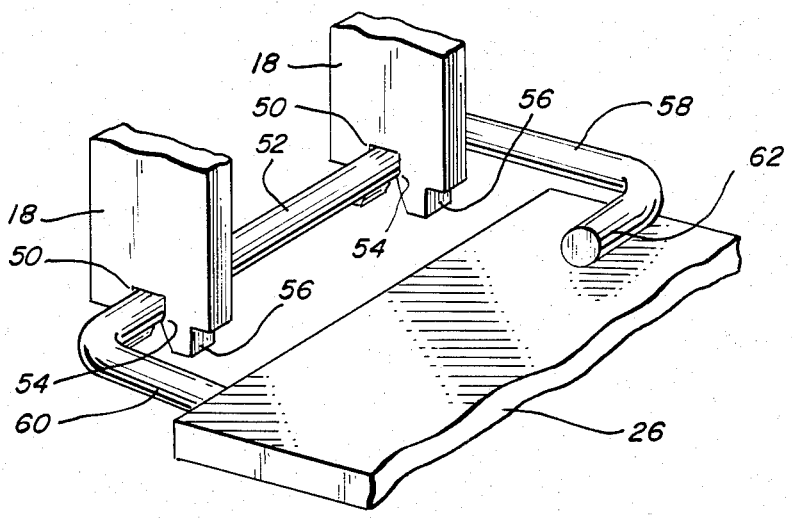
FIG. 3 is a detailed perspective view of a second alternate embodiment of the present invention.

FIG. 3 illustrates detail of a second alternate embodiment of the present invention wherein attachment tabs 18 extend from an attachment member (not shown). In this embodiment the attachment tabs 18 have in their bottom ends slots 50, which slots 50 are configured to receive and retain a stabilizing rod member 52. The slots 50 have, adjacent their entrance, ears 54 and extensions 56. The stabilizing rod member 52 is pressed into the slots 50 and during such pressing, the extensions 56 guide the stabilizing rod member 52 toward the slots 50. Upon exertion of pressure upon the stabilizing rod member 52 extensions 56 will flex outwardly allowing the stabilizing rod member 52 to ride past the ears 54 whereupon the extensions will return substantially to their original positions thereby movably entrapping the stabilizing rod member 52 within the slots 50. The stabilizing rod member 52 has an upper rod extension 58 and a lower rod extension 60, which rod extensions 58, 60 extend from the attachment tabs 18 toward the base 26. The upper rod extension 58 is bent at its end distal from the attachment tab 18 to form an upper rod rider 62 and the lower rod extension 60 is bent at its end distal from the attachment tab 18 to form a lower rod rider (not visible in FIG. 3). The upper rod rider 62 and the lower rod rider are substantially parallel to one another yet displaced from one another a distance sufficient to allow slidingly gripping engagement of the base between the upper rod rider 62 and the lower rod rider. Thus, slidingly gripping engagement of the base 26 is accomplished by the rod riders of the stabilizing rod member 52 and provide stabilization of a keytop 12 (not shown in FIG. 3) attached to the attachment tabs 18.

Figure 4:
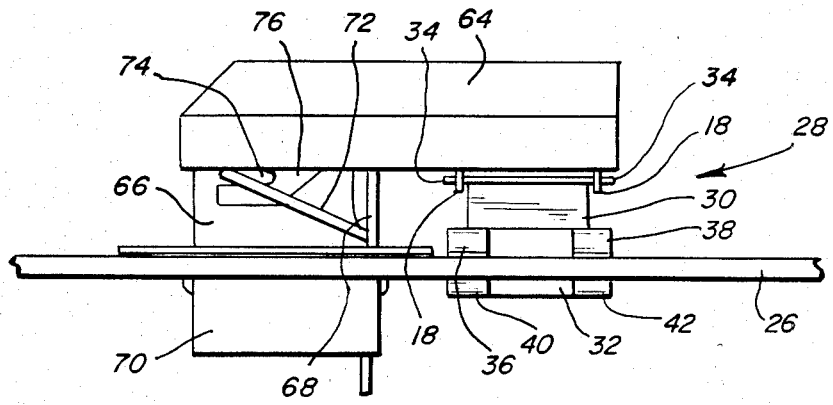
FIG. 4 is a side view of a large-area keyswitch employing the preferred embodiment of the present invention.

FIG. 4 illustrates, in side view, employment of the preferred embodiment of FIG. 1 in a large-area keyswitch environment. The keyswitch depicted in FIG. 4 is an L-shaped keytop 64 associated with a keyswitch 66. The keyswitch 66 illustrated in FIG. 4 is of the type disclosed in U.S. Pat. application Ser. No. 06/520,039, filed Aug. 3, 1983 now U.S. Pat. No. 4,453,063. Keyswitch 66, thus, has a wall 68 integrally joined with the housing 70 of the keyswitch 66 and retained between the wall 68 and the housing 70 is a stabilizing member 72 of a type conventionally known in the art. The stabilizing member 72 is slidingly engaged with the keytop 64 by way of a slot 74 defined by a support tab 76 attached to the keytop 64. The keyswitch is mounted by conventional means to a base 26. At a point distal from the keyswitch 66 the stabilizing apparatus 28 is attached to the keytop 64 by pins 34 and attachment tabs 18. Extending from the attachment tabs 18 toward the base 26 is a rigid member 30 and at the end of the rigid member 30 distal from the attachment tabs 18 is the engagement member 32. The engagement member 32 has upper legs 36 and 38 and lower legs 40 and 42 which slidingly grippingly engage the base 26. Thus, when the keytop 64 is depressed in the vicinity of the point of attachment of the stabilizing apparatus 28 to the keytop 64, the stabilizing apparatus 28 serves to minimize moment forces applied to the actuator (not shown) of the keyswitch 66 to minimize binding of the actuator within the housing 70 of the keyswitch 66.

It is to be understood that, while the detailed drawings and specific examples given describe preferred embodiments of the invention, they are for the purpose of illustration only, that the apparatus of the invention is not limited to the precise details and conditions disclosed and that various changes may be made therein without departing from the spirit of the invention which is defined by the following claims.

I claim:

1. An apparatus for stabilizing operational movement of an actuator for a keyswitch mounted to a base, said base having a top surface and a bottom surface, said apparatus comprising one or more unitary, substantially rigid members; said one or more members being movably attached to said actuator at a first end and having a gripping means at a second end for slidingly gripping said base by engaging said top surface and said bottom surface substantially adjacent a free edge of said base, said gripping means slidingly bearing against at least one of said top surface and said bottom surface in response to said operational movement of said actuator.

2. An apparatus for stabilizing operational movement of an actuator for a keyswitch mounted to a base as recited in claim 1 wherein said gripping means comprises a yoke, said yoke having at least one pair of legs joined by a bight, said base being slidingly grippingly engaged between said at least one pair of legs and said free edge extending toward said bight.

3. An apparatus for stabilizing operational movement of an actuator for a keyswitch mounted to a base as recited in claim 1 wherein said gripping means comprises a first leg having a first axis and a second leg having a second axis, said first axis being displaced a distance from said second axis, said distance being appropriate to enable said base to be received between said first leg and said second leg in slidingly gripping relation, said first leg engaging said top surface and said second leg engaging said bottom surface.

4. An apparatus for stabilizing operational movement of an actuator for a keyswitch mounted to a base as recited in claim 3 wherein said first axis is substantially parallel with said second axis.

5. An apparatus for stabilizing operational movement of an actuator for a keyswitch mounted to a base as recited in claim 1 wherein said gripping means comprises a channel having two arms, said base being slidingly grippingly engaged between said arms and said free edge extending into said channel.

* * * * *